US005188506A

United States Patent [19]

Creevy et al.

[11] Patent Number: 5,188,506

[45] Date of Patent: Feb. 23, 1993

[54] APPARATUS AND METHOD FOR PREVENTING LEAKAGE OF COOLING AIR IN A SHROUD ASSEMBLY OF A GAS TURBINE ENGINE

[75] Inventors: Clifford S. Creevy, Maineville; Terry T. Eckert, Fairfield, both of Ohio

[73] Assignee: General Electric Company, Cincinnati, Ohio

[21] Appl. No.: 750,991

[22] Filed: Aug. 28, 1991

[51] Int. Cl.[5] ..... F01D 11/08

[52] U.S. Cl. ..... 415/115; 415/173.1; 277/169; 277/177; 277/206 R; 29/888.3; 29/889.22

[58] Field of Search ..... 415/115, 116, 173.1, 415/173.3, 174.2; 277/168, 169, 173, 177, 206 R; 285/918; 251/900; 29/888.3, 889.22

[56] References Cited

U.S. PATENT DOCUMENTS

| | | | |
|---|---|---|---|
| Re. 33,199 | 4/1990 | Karr, Jr. | 277/206 R |
| 3,391,904 | 7/1968 | Albert et al. | 415/173.1 |
| 3,583,824 | 6/1971 | Smuland et al. . | |
| 3,836,279 | 9/1974 | Lee . | |
| 4,199,151 | 4/1980 | Bartos | 277/206 R |
| 4,261,584 | 4/1981 | Browne et al. | 277/206 R |
| 4,553,901 | 11/1985 | Laurello . | |
| 4,573,866 | 3/1986 | Sandy, Jr. et al. . | |
| 4,674,952 | 6/1987 | Osterstrom | 415/170.1 |
| 4,730,832 | 3/1988 | Cederwall et al. | 415/115 |
| 4,732,531 | 3/1988 | Minoda et al. | 415/173.1 |
| 4,752,184 | 6/1988 | Liang . | |
| 5,064,343 | 11/1991 | Mills | 415/173.3 |
| 5,092,735 | 3/1992 | Katy et al. | 415/115 |

FOREIGN PATENT DOCUMENTS

| | | | |
|---|---|---|---|
| 1425364 | 2/1976 | United Kingdom | 277/206 R |
| 2168110 | 6/1986 | United Kingdom | 415/115 |

*Primary Examiner*—Edward K. Look
*Assistant Examiner*—Christopher Verdier
*Attorney, Agent, or Firm*—Jerome C. Squillaro; John R. Rafter

[57] ABSTRACT

An assembly for preventing cooling air from leaking from a plenum region formed by a shroud support and a shroud. The shroud support and shroud being so connected as to form a gap which leads from the plenum region to a cavity. The cavity being located in the forward hook region of the shroud support. A rope seal fills the cavity and prevents cooling air from leaking into the cavity causing the cooling air to remain in the plenum region.

8 Claims, 2 Drawing Sheets

APPARATUS AND METHOD FOR PREVENTING LEAKAGE OF COOLING AIR IN A SHROUD ASSEMBLY OF A GAS TURBINE ENGINE

CROSS-REFERENCE

Reference is made to a co-pending and related case filed concurrently herewith having U.S. patent application Ser. No. 07/750,993, which is herein incorporated by reference.

BACKGROUND OF THE INVENTION

1. Field of the Invention

The present invention relates to seals used in gas turbine engines. More particularly, the present invention relates to a seal for filling a cavity formed by the forward hook region of a shroud support and a shroud. The shroud support and the shroud form a plenum region which connects to the cavity by means of a gap which lies between the forward foot regions of the shroud and shroud support. The seal of the present invention prevents cooling air in the plenum region from leaking into the cavity.

2. Discussion of the Background

In a gas turbine engine, very hot gas exits a combustor and is utilized by a turbine stage for conversion to mechanical energy. This mechanical energy drives an upstream high pressure compressor. The turbine stage is comprised of a plurality of rotor blades which are arranged circumferentially, these rotor blades are the means by which the hot gas exiting the combustor is converted to mechanical energy.

Located radially outward of the rotor blades are a plurality of shrouds which are circumferentially connected and which provide a tight radial clearance about the tips of the rotor blades so as to provide efficient operation of the engine. The shrouds are supported by a plurality of shroud supports which are located radially outward from the shrouds. Typically two shrouds are supported by each shroud support, with the shroud supports being secured to an outer casing of the engine. The shrouds and shroud supports must be segmented circumferentially to accommodate differential thermal expansion rates and to maintain blade tip clearance control.

Each shroud connects to a shroud support in such a manner that a plenum region is formed which is located between the lower mid-section of the shroud support and the upper mid-section of the shroud. This plenum region accommodates cooling air which originates from the upstream high pressure compressor. This cooling air travels in an aft direction radially outward of the combustor and makes its way to the shroud supports. Each shroud support is provided with a plurality of holes which serve as channels for directing the cooling air to the plenum region formed by the shroud and shroud support.

This cooling air in the plenum region impinges on the shrouds for purposes of cooling the shroud. This cooling is necessary because the hot gases which enter the turbine first stage are at temperatures levels which can exceed the melting point of the shrouds. Since the shrouds are exposed to such temperature levels, the cooling air is necessary for the safe operation of the engine. Each shroud is further provided with film holes which extend in a radially inward direction through the shroud for purposes of convectively cooling the shroud interior.

To the front of the plenum region is a forward foot section of the shroud support which forms a forward gap with a forward foot section of a connected shroud. The forward gap leads to a cavity area formed by a forward hook region of the shroud support and connected shroud. To the aft of the plenum region is an aft foot section of the shroud support which forms an aft gap with an aft foot section of the connected shroud.

These gaps to the front and to the rear of the plenum region have resulted in significant amounts of cooling air being wasted, the cooling air leaking out due to the fact that the air in the plenum region is under greater pressure than regions to the front and rear of the plenum region. The gaps are necessary for purposes of assembling the shroud and shroud supports as well as for purposes of accommodating thermal expansion, as has been previously mentioned.

The circumferentially segmented shrouds and shroud supports result in the formation of a forward annular cavity, a forward annular gap, an annular plenum region, and an aft annular gap.

The more air that is utilized by the engine for cooling results in a diminished amount of air which can be used for the purpose of generating thrust. Until recently the leakage paths (i.e., gaps) provided to the front and rear of the plenum region were considered to be an insignificant problem. However, the significance of the problem has been reconsidered in light of increased performance demands and higher shroud cooling requirements due to elevated gas path temperatures.

The related case entitled "Shroud Support Rail and Method for Assembling in Turbine Engine", U.S. patent application Ser. No. 07/750,993, filed concurrently herewith, has addressed the problem of leakage to the aft of the plenum region.

Therefore, a need exists for a mechanism which significantly reduces or eliminates the leakage of cooling air from the plenum region through a cavity in the forward hook region of a shroud support to the gas path, thereby bypassing the film holes.

SUMMARY OF THE INVENTION

Accordingly, one object of the present invention is to provide a seal which significantly reduces the leakage of cooling air from a plenum region, formed by a shroud support and connected shroud, to a cavity located in the forward hook region of the shroud support.

Yet another object of the present invention is to provide a seal in the cavity formed by the forward hook region of a shroud support which aids in the efficient operation of a gas turbine engine.

These and other valuable objects and advantages of the present invention are provided by an assembly for preventing leakage of cooling air from a plenum region located in a gas turbine engine. The assembly includes a shroud support which is connected to a shroud so as to form the plenum region. The shroud and shroud support are so connected as to form a gap which extends from the plenum region to a cavity. A sealing means for preventing the leakage of cooling air from the plenum region to the cavity is assembled between and makes contact with the shroud and shroud support thereby filling the cavity.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it is understood that like reference numerals designate identical or corresponding parts throughout the respective figures.

DETAILED DESCRIPTION OF THE INVENTION

Figure 1:
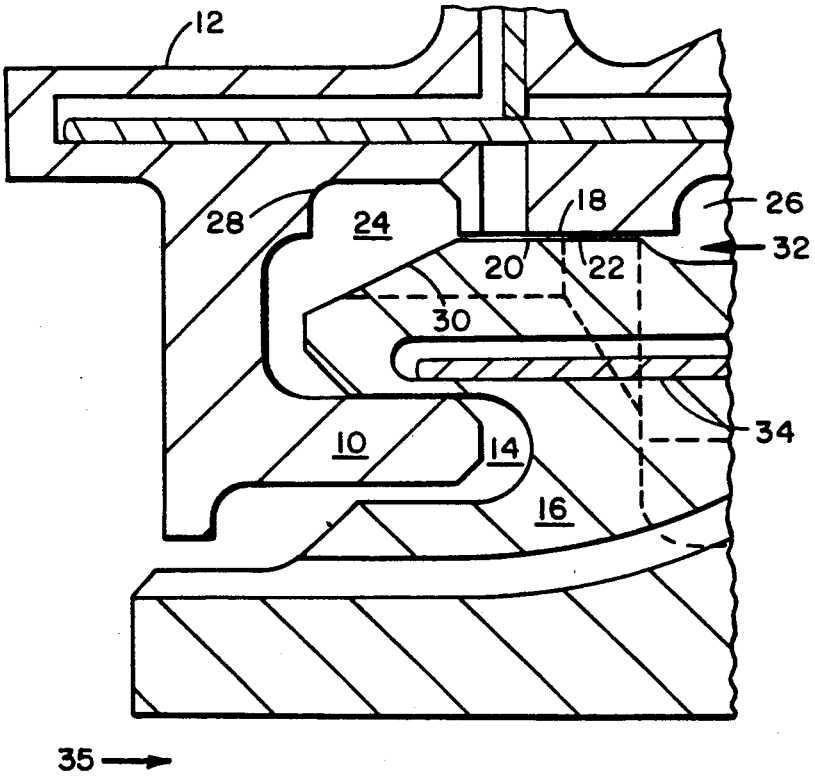
FIG. 1 (PRIOR ART)
FIG. 1 is a prior art schematic, side view illustration of the front hook region of a shroud support and connected shroud.

With reference to the prior art illustration of FIG. 1, a forward hook 10 of shroud support 12 is engaged in accommodating groove 14 of shroud 16. The shroud support 12 has a forward foot section 18 which is positioned above or radially outward of forward foot section 20 of shroud 16 to form gap 22. A cavity 24 is located above or radially outward of forward hook 10 and accommodating groove 14, with cavity 24 being located to the front of gap 22. Gap 22 is necessary for the assembly of the shroud support 12 to the shroud 16 and unfortunately constitutes an air passage which connects plenum 26 with cavity 24. Shroud support cavity wall 28 and shroud cavity wall 30 define the boundaries of cavity 24. The plenum 26 contains cooling air 32 which is allowed to leak into cavity 24 by traveling through gap 22.

Cooling air 32 which leaks into cavity 24 bypasses film holes 33 and flows freely to the gas path 35 through gaps at the circumferential ends of the shroud support 12. The cooling function of cooling air 32 is reduced in effectiveness as a result of cooling air 32 bypassing the film holes 33. As a result, more cooling air is needed which means less air is available for engine operation.

A spline seal 34 is connected to shroud 16 to fill space between an adjacent shroud segment (not shown). The purpose of the spline seal is to block the leakage path between shroud segments. This leakage path allows cooling air 32 to flow from plenum 26 to gas path 35 without passing through the film holes 33 in shroud 16 (see FIG. 2). A plurality of shrouds and shroud supports such as shroud 16 and shroud support 12 are connected in a circumferential manner so that a plurality of cavities such as cavity 24 form an annular cavity, a plurality of gaps such as gap 22 form an annular gap, and a plurality of plenums such as plenum 26 form an annular plenum. The annular cavity, annular gap, and annular plenum are located radially outward of the turbine rotor blades.

Figure 2:
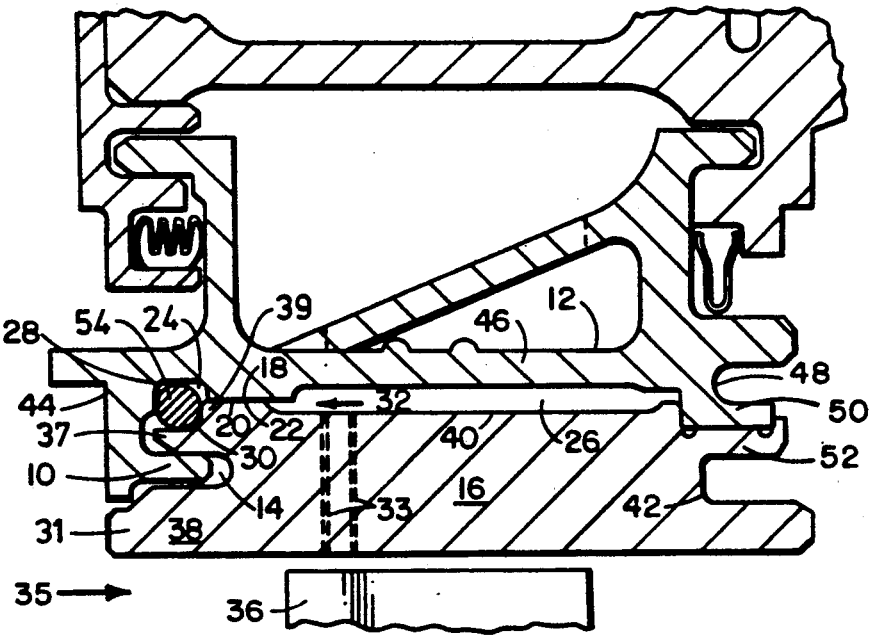
FIG. 2 is a side view schematic illustration of a shroud support and connected shroud which depicts the sealing means of the present invention.

With reference to FIG. 2, first-stage turbine rotor blade 36 is positioned radially inward of shroud 16. Shroud 16 is comprised of a forward region 38, a mid-section region 40, and an aft region 42. Forward region 38 of shroud 16 includes a radially inner portion 31 and a radially outer portion 37 forming axially extending groove 14 therebetween, and radially outer portion 37 includes a forward facing step 39 for accepting a rope seal 54. Shroud 16 connects to shroud support 12, with shroud support 12 being comprised of a forward region 44 which includes forward hook 10. Shroud support 12 is further comprised of a mid-section region 46 and an aft region 48. An aft foot section 50 of the shroud support 12 interfaces with an aft foot section 52 of the shroud 16. The radially inward side of mid-section 46 of shroud support 12 together with the radially outward side of mid-section 40 of shroud 16 form the boundaries of plenum 26. Film holes 33 extend from the radially outward side to the radially inward side of shroud 16, with gas path 35 being located radially inward of shroud 16.

Still referring to FIG. 2, gap 22 is formed by the positioning of forward foot section 18 of shroud support 12 relative to the forward foot section 20 of shroud 16. The rope seal 54 is positioned in and fills cavity 24 with the rope seal pressing against cavity wall 28 of shroud support 12 and cavity wall 30 of shroud 16, with cavity wall 30 comprising forward facing stop 39. The rope seal 54 is made of inconel braid filled with silica. The rope seal effectively blocks cooling air from proceeding in a forward direction through gap 22. The seal 54 prevents a pressure differential from existing at the front of gap 22 and plenum 26. Thus, the cooling air in plenum 26 remains available for the purpose of flowing through film holes 33 which results in the interior of shroud 16 being convectively cooled.

Figure 3:
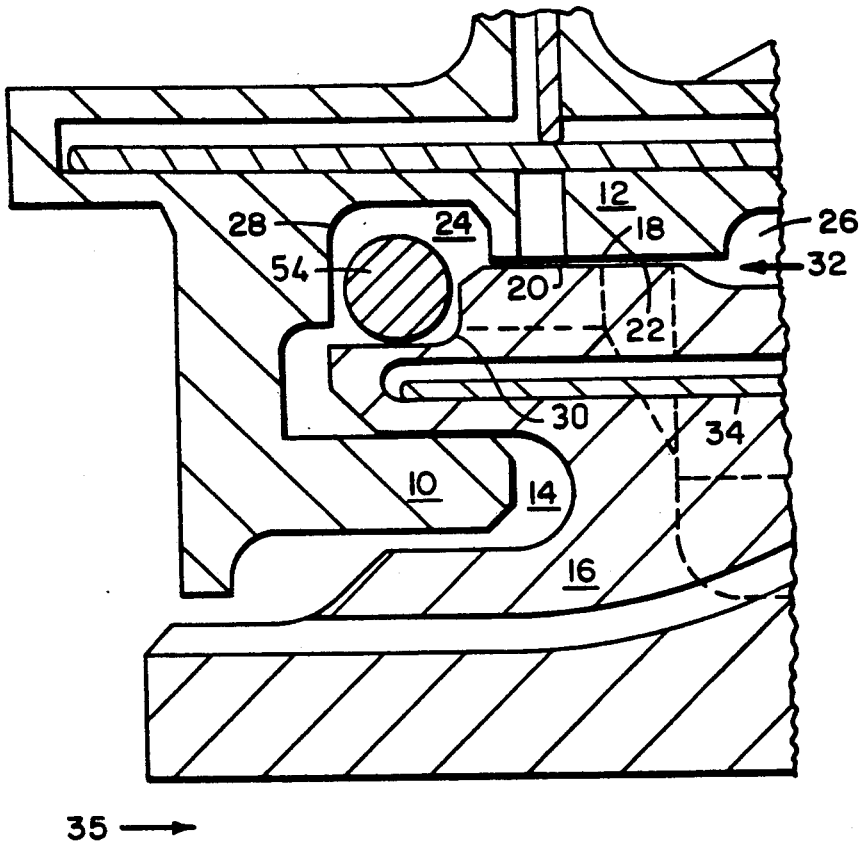
FIG. 3 is a schematic, side view illustration of the front hook region of a shroud support whose cavity is filled by the sealing means of the present invention.

With reference to FIG. 3, an illustration similar to FIG. 1 is presented; however, rope seal 54 is seen to be positioned in the cavity 24 with the rope seal 54 contacting cavity wall 28 of shroud support 12 and cavity wall 30 of shroud 16. The rope seal 54 prevents cooling air flow from getting from the top right of cavity 24 to the bottom left (i.e., bottom forward side) of the cavity 24. The rope seal is placed in and extends circumferentially around the annular cavity formed by the summation of shroud supports and shrouds during assembly of the engine.

Figure 4A:
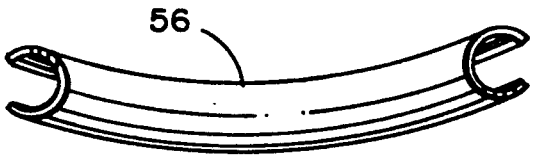
FIG. 4A is a plan view of a sealing means according to a second embodiment of the invention.
Figure 4B:
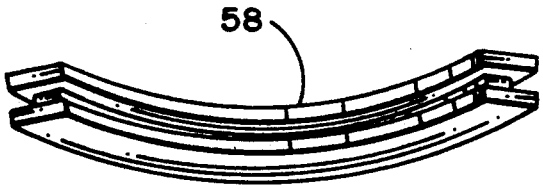
FIG. 4B is a plan view of a sealing means according to a third embodiment of the invention.

As an alternative to rope seal 54, with reference to FIG. 4A, a C-seal 56 can be used to fill the cavity 24 (FIG. 3). As a further alternative, with reference to FIG. 4B, an E-seal 58 can be used as a sealing means.

The present invention significantly reduces the leakage of cooling air from the plenum to the forward hook region of a shroud support and thereby contributes to the operational efficiency of a gas turbine engine.

The foregoing detailed description of the preferred embodiments of the invention is intended to be illustrative and non-limiting. Many changes and modifications are possible in light of the above teachings. Thus, it is understood that the invention may be practiced otherwise than as specifically described herein and still be within the scope Of the appended claims.

What is claimed is:

1. An assembly for preventing leakage of cooling air from a plenum region located in a gas turbine engine, said assembly comprising:

a shroud support;

a shroud connected to said shroud support so as to form the plenum region and a cavity, and wherein said shroud support and said shroud are so connected that a gap extends form the plenum region to said cavity;

sealing means for preventing the leakage of cooling air from the plenum region to the cavity, said sealing means contacting said shroud support and said shroud;

wherein said sealing means causes the cooling air to be directed from the plenum through a plurality of film holes which extend through an axially extending mid-section region of said shroud which result sin an interior of said shroud being convectively cooled;

wherein each of said film holes have an inlet at a radially outward and radially facing surface of said shroud which forms a portion of a boundary of the plenum and an outlet at a radially inward and radially facing surface of said shroud adjacent a gas path of the gas turbine engine; and wherein said shroud includes a forward region, said forward region including a radially inner portion and a radially outer portion forming an axially extending groove therebetween, said groove engaging a forward hook of said shroud support, said radially outer portion including a forward facing step for accepting said sealing means, said step being radially outward of said groove.

2. An assembly according to claim 1 wherein a forward foot region of said shroud support and a forward foot region of said shroud form the gap.

3. An assembly according to claim 2 wherein said shroud has a cavity wall region comprising said forward facing step and said shroud support has a cavity wall region, said sealing means contacting the cavity wall region of said shroud and the cavity wall region of said shroud support.

4. An assembly according to claim 3 wherein said sealing means is selected from the class including rope seals, C seals, and E seals.

5. An assembly for preventing leakage of cooling air from an annular plenum region located in a gas turbine engine, said assembly comprising:

a plurality of circumferentially connected shroud supports;

a plurality of circumferentially connected shrouds which are connected to said plurality of shroud supports so as to form the annular plenum region and an annular gap, and wherein said plurality of shrouds are so connected that said annular gap extends form the annular plenum region to an annular cavity;

sealing means for preventing the leakage of cooling air form the annular plenum region to the annular cavity, said sealing means contacting the plurality of shroud supports and the plurality of shrouds;

wherein said sealing means causes the cooling air to be directed from the annular plenum region through a plurality of film holes in each of said shrouds, said film holes extending through an axially extending mid-section region of each of said shrouds which results in an interior of each of said shrouds being convectively cooled;

wherein each of said film holes have an inlet at a radially outward and radially facing surface of one of said shrouds, said outward surface forming a portion of a boundary of the annular plenum region, and an outlet at a radially inward and radially facing surface of said one of said shrouds, said inward surface being adjacent a gas path of the gas turbine engine; and wherein each of said shrouds includes a forward region, said forward region including a radially inner portion and a radially outer portion forming an axially extending groove therebetween, said groove engaging a forward hook of one of said shroud supports, said radially outer portion including a forward facing step for accepting said sealing means, said step being radially outward of said groove.

6. An assembly according to claim 5 wherein said sealing means is selected form the class comprising rope seals, C seals, and E seals.

7. A method of assembling a gas turbine engine, the gas turbine engine including a plurality of circumferentially connected shroud supports which are connected to a plurality of circumferentially connected shrouds, the plurality of shroud supports and the plurality of shrouds forming an annular plenum for accommodating cooling air, the plurality of shroud supports and the plurality of shrouds being so connected that an annular gap extends form the annular plenum to an annular cavity, each of the shrouds having a plurality of film holes extending through an axially extending mid-section region of the shroud, each of the film holes having an inlet at a radially outward and radially facing surface of the shroud which forms a portion of a boundary of the annular plenum and an outlet at a radially inward and radially facing surface of the shroud adjacent a gas path of the gas turbine engine, each of the shrouds including a forward region, said forward region including a radially inner portion and a radially outer portion forming an axially extending groove therebetween, said groove engaging a forward hook of one of the plurality of shroud supports, the method comprising the steps of:

forming a forward facing step in the radially outer portion of each of the shrouds, at a location radially outward of the groove, for creating a portion of the annular cavity;

filling the annular cavity with a sealing means for preventing the cooling air for leaking from the annular plenum to the annular cavity; and causing the cooling air to be directed form the annular plenum through the plurality of film holes for convectively cooling an interior of each of the shrouds.

8. A method of assembling according to claim 7 wherein the sealing means is selected from the class including rope seals, C seals, and E seals.

* * * * *